US009879197B2

(12) United States Patent
Sugg et al.

(10) Patent No.: US 9,879,197 B2
(45) Date of Patent: Jan. 30, 2018

(54) VEGETABLE OILS, VEGETABLE OIL BLENDS, AND METHODS OF USE THEREOF

(71) Applicants: Edward A. Sugg, South Riding, VA (US); David W. Sugg, Ashburn, VA (US)

(72) Inventors: Edward A. Sugg, South Riding, VA (US); David W. Sugg, Ashburn, VA (US)

( * ) Notice: Subject to any disclaimer, the term of this patent is extended or adjusted under 35 U.S.C. 154(b) by 85 days.

(21) Appl. No.: 14/491,787

(22) Filed: Sep. 19, 2014

(65) Prior Publication Data

US 2015/0017346 A1 Jan. 15, 2015

Related U.S. Application Data

(63) Continuation of application No. PCT/US2013/032351, filed on Mar. 15, 2013.

(60) Provisional application No. 62/000,703, filed on May 20, 2014, provisional application No. 61/612,685, filed on Mar. 19, 2012.

(51) Int. Cl.

| | |
|---|---|
| ***B05D 5/12*** | (2006.01) |
| ***C10M 105/36*** | (2006.01) |
| ***F41A 29/04*** | (2006.01) |

(52) U.S. Cl.

CPC ..... *C10M 105/36* (2013.01); *F41A 29/04* (2013.01)

(58) Field of Classification Search

CPC combination set(s) only.
See application file for complete search history.

(56) References Cited

U.S. PATENT DOCUMENTS

| | | | | |
|---|---|---|---|---|
| 4,408,960 | A | 10/1983 | Allen | |
| 5,888,947 | A | 3/1999 | Lambert et al. | |
| 6,063,447 | A | 5/2000 | Morand et al. | |
| 6,153,571 | A | 11/2000 | Komocki et al. | |
| 6,225,271 | B1 | 5/2001 | Wright, Jr. et al. | |
| 6,383,992 | B1 | 5/2002 | Garmier et al. | |
| 6,534,454 | B1 | 3/2003 | Garmier et al. | |
| 6,919,302 | B2 | 7/2005 | Legros et al. | |
| 2003/0069146 | A1 | 4/2003 | Garmier | |
| 2004/0234701 | A1 * | 11/2004 | Caton | A21D 2/145 427/430.1 |
| 2006/0289087 | A1 | 12/2006 | Lachance | |
| 2010/0292118 | A1 * | 11/2010 | Horton | A61K 8/0208 510/138 |
| 2011/0190176 | A1 | 8/2011 | Perduk et al. | |
| 2012/0042900 | A1 | 2/2012 | Horton | |

FOREIGN PATENT DOCUMENTS

| | | | |
|---|---|---|---|
| EP | 0 494 707 | A1 | 7/1992 |
| EP | 1464913 | A2 | 10/2004 |
| GB | 1 232 322 | A | 5/1971 |
| JP | H10-095945 | A | 4/1998 |
| WO | WO 98/30668 | A1 | 7/1998 |

OTHER PUBLICATIONS

Extended European Search Report of European Patent Application No. 13764872.1 dated Nov. 2, 2015.
Sims, "Engineering Formulas," Industrial Press, Inc., vol. 1, pp. 131, 1999.
United States Fire Administration, "Commercial Cooking: Cooking Oil Characterisits," www.usfa.fema.gov/nfaonline, http://www.usfa.fema.gov/training/coffee_break/, May 19, 2015.
University of Colorado Colorado Springs, "Fatty Acid Composition of Fats and Oils," http://www.uccs.edu/Documents/danderso/fats_oils.pdf, pp. 1-2, 2007.
Ventura Foods, "Safety Data Sheet (SDS) Cottonseed Oil," http://www.venturafoods.com/wp-content/uploads/2016/04/VF-SDS-Cottonseed-Oil.pdf, pp. 1-7, May 22, 2015.

* cited by examiner

*Primary Examiner* — Austin Murata
(74) *Attorney, Agent, or Firm* — Arent Fox LLP

(57) ABSTRACT

An oil composition including at least three vegetable oils, each vegetable oil being distinct from the other and each having a smoke point above 200° F., wherein the combined volume of the at least three vegetable oils is at least about 25% of the total volume of the oil composition. A method of removing or preventing carbon fouling on a mechanical component of a device, comprising depositing a vegetable oil composition on the mechanical component of the device, wherein the vegetable oil composition comprises at least one vegetable oil having a smoke point above 200° F., wherein the at least one vegetable oil is present in an amount of at least about 25% by volume of the total volume of the oil composition and wherein operation of the device deposits carbon on the mechanical component.

7 Claims, 12 Drawing Sheets

VEGETABLE OILS, VEGETABLE OIL BLENDS, AND METHODS OF USE THEREOF

CROSS-REFERENCE TO RELATED APPLICATIONS

This application is a continuation of International Application PCT/US2013/032351 filed Mar. 15, 2013, which claims priority to U.S. Provisional Application No. 61/612,685 titled "VEGETABLE OILS, VEGETABLE OIL BLENDS, AND METHODS OF USE THEREOF," filed on Mar. 19, 2012, and U.S. Provisional Application No. 62/000,703, titled "USE OF HIGH TEMPERATURE OILS TO ENHANCE FIREARM AND OTHER MECHANICAL DEVICE OPERATION/RELIABILITY" filed on May 20, 2014, the entirety of which are hereby incorporated by reference herein.

BACKGROUND OF THE INVENTION

Field of the Invention

Aspects of the present invention relate to vegetable oils, vegetable oil blends, and various uses thereof. More particularly, aspects of the present invention relate to vegetable oils and their uses with mechanical components, for example, firearms.

Background

It is known in the related art to use cleaners or, less preferably, cleaner/lubricant/protectant (CLP) oils to remove carbon fouling from mechanical parts. In particular, in the area of firearm operation, such as AR-15 or M-16 firearms, when a round is fired, the combustion process deposits carbon within the firearm, as shown in FIG. 1. The depositing of carbon leading to fouling is a well known problem in the art, an example of which is shown in the photostat FIG. 2. Carbon fouling requires a time-consuming cleaning process that take up to three days for sufficient removal of carbon to allow proper operation of the firearm. When the carbon fouling becomes too great, the firearm will malfunction or cease operation entirely, which is a critical problem in battle or defensive situations, for example, and a significant nuisance to civilian shooters.

Currently, various lubricant compositions are known for use on firearms to remove carbon fouling from the firearm. However, known compositions do not satisfactorily remove carbon, especially at temperatures above 160° F. Ambient temperatures in current combat zones can often reach 120° F. The sun can heat black metal objects another 40° F. or more before the weapon is even fired. Tests have shown that critical moving parts of the weapon can reach 70° F. above ambient temperature in even modest firing cadences, which are further magnified in battle conditions. Furthermore, some known compositions are synthetic and harmful when exposed to the human body. For example, several known lubricant compositions include: Mobil 1® 10W-30 sold by Mobil, SLIP2000™ Carbon Killer sold by SPS Marketing, FrogLube® sold by AUDEMOUS INC, Gunzilla® sold by TopDuck Products, LLC, Hoppe's Elite® Gun Cleaner sold by Bushnell Outdoor Products, and Break Free® sold by SAFARILAND. Each of these commercial compositions has significant flaws. For example, Mobil 1® 10W-30 synthetic is hydrocarbon based, creates a sludge when contacted with carbon fouling, and is not polar. SLIP2000™ Carbon Killer does not lubricate, strips metal of oils, and damages anodized aluminum and blued steel. Stripping oils from metals in a firearm can cause the firearm to seize. FrogLube® is only functional in a very narrow temperature range. It solidifies at 48° F., and smokes at 150° F. After smoking, it leaves behind a sticky gummy residue. Gunzilla® is harmful or fatal if swallowed, and is a very poor performing cleaner. Hoppe's Elite® does not act as a lubricant and removes oils and contains hazardous diethylene glycol monobutyl ether. Break Free® contains petroleum distillates. Petroleum distillate products contain harmful, carcinogenic components and are treated as hazardous materials both in shipment and disposal.

U.S. Pat. No. 6,534,454 is directed to a biodegradable vegetable oil composition comprising a triglyceride oil, an antioxidant, and other oils. The other oils may be synthetic ester base oil, polyalphaolefin, or unrefined, refined, or rerefined oils. The triglyceride oils are vegetable oils.

U.S. Pat. No. 6,383,992 is directed to biodegradable vegetable oil compositions having at least one triglyceride oil, a pour point depressant, an antioxidant, and other oils. The triglyceride oils are vegetable oils.

U.S. Pat. No. 6,919,302 is directed to the use of an oil composition for temporary treatment of metal surfaces.

There remains a need in the art for natural, safe, oil compositions and methods of using the compositions for avoiding and removing carbon fouling in mechanical components, and providing highly heat-resistant lubrication and a fouling resistant environment.

SUMMARY OF THE INVENTION

Aspects of the present invention provide, among other things, vegetable oil compositions and methods of use thereof to avoid and reduce carbon fouling on mechanical components, lubricate mechanical components, and provide long-term carbon fouling protection.

In one example variation, a pure vegetable oil or blend of vegetable oils may be applied to a mechanical component of a device that is used in an environment where carbon fouling should be avoided or removed to improve performance, such as on various parts of firearms, bicycles, chain saws, and engines. The oil compositions may also be used as a lubricant, such as in fishing equipment.

In another variation, a blend of vegetable oils includes at least three two distinct vegetable oils, each having a smoke point above 200° F.

In another variation the method of removing or preventing carbon or other contaminant fouling on a mechanical component of a device, comprises depositing a vegetable oil composition on the mechanical component of the device, wherein the vegetable oil composition comprises at least one vegetable oil having a smoke point above 200° F., wherein the at least one vegetable oil is present in an amount of at least about 25% by volume of the total volume of the oil composition; and wherein operation of the device deposits carbon on the mechanical component.

In another variation, the vegetable oils may be applied to a mechanical component using various methods, such as depositing, heat treating, pressure treating, and immersing, or applying onto operating surfaces of the device and its subsequent operation.

In another variation, the oil composition, comprises at least three vegetable oils, each vegetable oil being distinct from the other and each having a smoke point above 200° F., wherein the combined volume of the at least three vegetable oils is at least about 25% of the total volume of the oil composition.

Additional advantages and novel features of various aspects of the present invention will be set forth in part in the description that follows, and in part will become more apparent to those skilled in the art upon examination of the following or upon learning by practice thereof.

DETAILED DESCRIPTION

Figure 1:
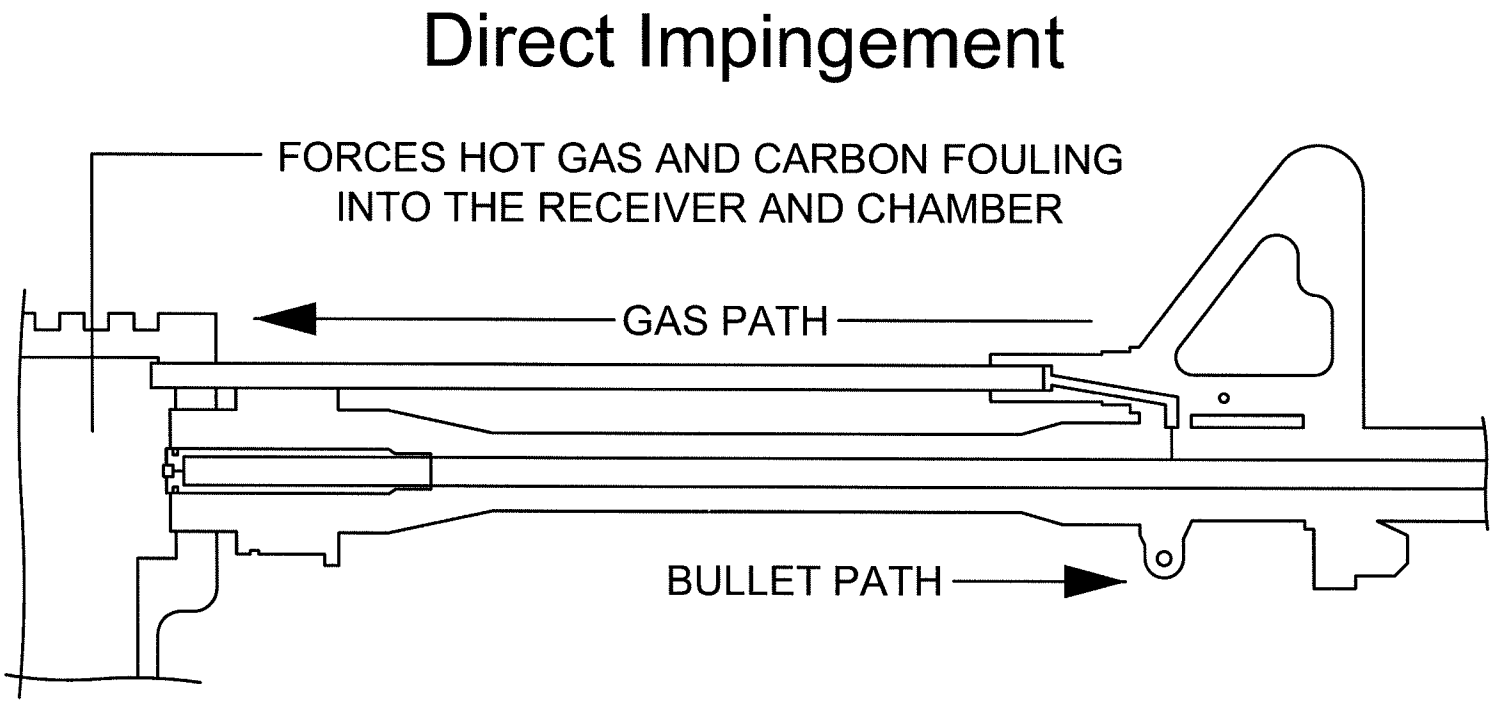
FIG. 1 shows a prior art firearm schematic showing where carbon deposits occur.
Figure 2:
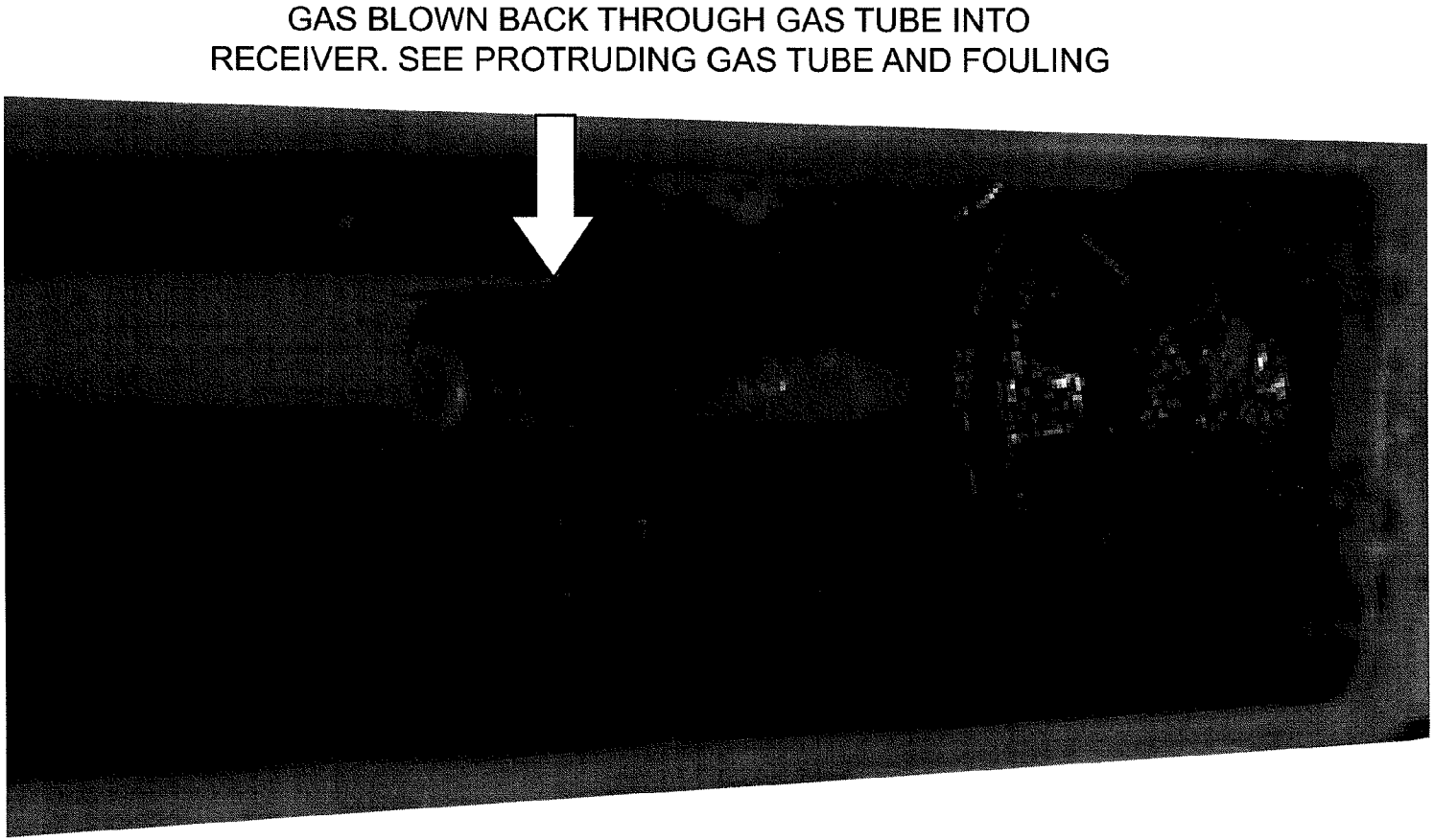
FIG. 2 shows a prior art firearm fouled with carbon.

Aspects of the present invention include a method of removing or preventing carbon fouling on a mechanical component of a device by depositing a vegetable oil composition on the mechanical component. Aspects of the present invention also include components and makeup of various vegetable oil compositions. As used herein, the term "about" means±10%, more preferably ±5%, still more preferably ±1% of the given value.

Vegetable oils, as used herein, means any single natural, non-petroleum, non-synthetic oil derived from a plant, vegetable or fruit or shrub or flower or tree nut, or any combination of natural, non-petroleum, non-synthetic oils derived from a plant, vegetable or fruit or shrub or tree nut. In an aspect of the present invention it has been surprisingly found that pure vegetable oils and various vegetable oil blends are superior to commercially available products in removing or avoiding carbon fouling on mechanical components. In addition, the vegetable oils act as a lubricant. Example methods include the application to a mechanical component that is part of device where operation of the device results in carbon being deposited on the mechanical component, including devices that are used in an environment where carbon fouling should be avoided or removed to improve performance. For example, the vegetable oils and blends may be applied to portions of firearms, bicycles (for example mountain bikes), and engines. The vegetable oils may also be used as a lubricant, for example in fishing equipment.

In an aspect of the present invention, the vegetable oils may be used to form a carbon resistant film by applying the oils to mechanical components, and allowing the oil to oxidize, such as by exposing the oil to heat, air, or UV light, which forms a hard dry film. This resulting dry film or wet oil layer is resistant to carbon and other fouling. In addition, in some variations, the film or wet oil layer may enhance lubrication and/or other properties. The mechanical component is preferably a component of a device that, when the device is operated, carbon is deposited on the mechanical component. This method is discussed in more detail below. Once applied to a mechanical component, the oil composition has proven to be highly resistant to water and resistant to soap sand other cleaning agents, as compared to known petroleum based or synthetic oils tend to wash off when exposed to water spray or rain.

The oil compositions may be applied to carbon steel parts, including bare steel, phosphate coated steel, chrome coated steel, ceramic coated steel, and the like, stainless steel parts, titanium parts, aluminum parts, including anodized or other coated aluminum, and nickel alloys. When used in a firearm, the parts of the firearm that may be coated include the parts that are subject to fouling as the result of gunpowder combustion, or having reciprocating or frictional contact surfaces. For example, such parts may include fire control group parts, including triggers, hammers, disconnectors, and trigger pins, firing pins, chambers, bolts, bolt faces, bolt carriers, breach faces, camming pins, pistons, operating/piston rods, gas tubes, barrels, slides and retention rails on pistols, upper and lower receivers, charging handles, feed trays, and magazine followers. When used on a bicycle, the oil compositions may be applied to bicycle chains and gears, such as derailleur gears, for example, and on control mechanisms such as shift and brake cables. When used in an engine, the oil compositions may be applied to any of the moving parts of the engine including valves, pistons, and ball bearings, for example. When used in fishing equipment, the oil compositions may be applied to reels and gears, for example.

A single vegetable oil or vegetable oil blend that is suitable for the above uses includes any single oil or blend that sufficiently reduces carbon or other contaminant fouling or avoids carbon or other contaminant build up. In an aspect of the present invention, the composition that may be used in the above manner may include at least about 25% vegetable oil, more preferably at least about 50% vegetable oil, still more preferably at least about 75%, and most preferably about 100% or 100% vegetable oil, by volume. Preferably, for some applications, the vegetable oil should have a smoke point higher than 200° F., more preferably above 300° F., and yet more preferably more 400° F., in order to maintain the oil integrity even at very high operating temperatures, which often occurs in firearms. Additionally, oils that have a high smoke point are desirable due to their inherent heat resistance. Highly refined vegetable oils are also useful for some applications. It has been found that the mixture of constituent oils disclosed herein provides a synergistic effect in which the combination of oils (the oil composition) has and higher smoke point than any of the individual oils by themselves.

Higher refined vegetable oils are purer as compared to unrefined vegetable oils. In another aspect of the present invention, at least one of or all of the vegetable oils may be high oleic. High oleic oils have a high degree of oleic acid, for example approximately 80% by weight oleic acid or greater, preferably 86% or greater, more preferably 90% or great, and even more preferably 95% or greater. By using high oleic acid oils that have a high monounsaturated to polyunsaturated fat ratio, oxidation can be reduced. It has been found that the oxidation of the vegetable oils in accordance with aspects of the instant invention yields a hard, lubricious or slick surface that is resistant to carbon fouling, which is discussed below. Generally, the desired ratio of monounsaturated to polyunsaturated fats in accordance with aspects of the present invention is at least about 3:1, and for some applications, preferably greater than 3:1. At least one or all of the oils in the oil composition may be high oleic. Reducing the polyunsaturated fats also enhances the temperature range (pour point to smoke point range) as well as the storage stability.

In accordance with aspects of the present invention, some variations of vegetable oil also reduce waxes and other contaminants, which ensures improved characteristics at low temperatures and also reduces gumming of oil in the firearm or other mechanical devices. Improved characteristics include improved oxidative stability and lower pour point. Accordingly, for some variations of the present invention, the oil composition may remain in liquid form at temperatures as low as about −35° F. and as high as about 500° F.

The oil compositions may have a pour point of about −40° F. to about 25° F., a cloud point of about 5° F. to about 70° F., and flash point of at least 450° F., more preferably at least 500° F., still more preferably at least 550° F. In an aspect of the present invention, the vegetable oil compositions may include one or more of the above properties.

Also, vegetable oils have a polar nature, which is not a characteristic found in petroleum-based products. The polarity ensures that the oil attracts strongly and penetrates deeply into the host metal and adheres better than non-polar oils, a feature that is highly desirable in a mechanical device that is blasted by gases, carbon, high heat, and extreme gravitational forces. The reciprocating bolt carrier on an M-16, for example, accelerates from 0 to over 40 miles per hour in only 20 milliseconds, in a distance of approximately one inch. This feature of oils in accordance with aspects of the present invention keeps the gun running long after a conventional lubricant has burned off and allowed carbon overload to occur. Because known petroleum-based products do not have this quality, the products do not have the attraction and penetration of the oil compositions.

Figure 3:
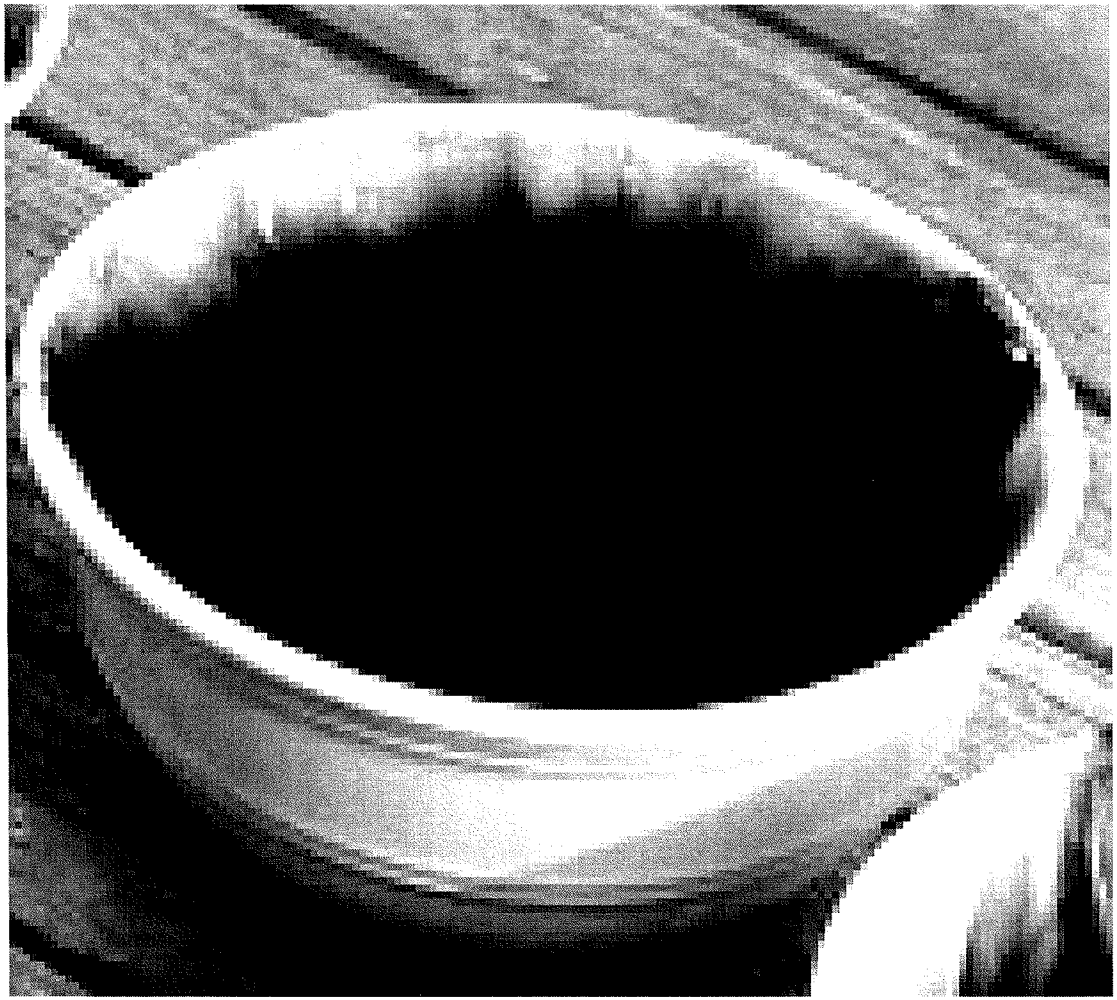
FIG. 3 shows pictures of a fouled bowl before testing.
Figure 4:
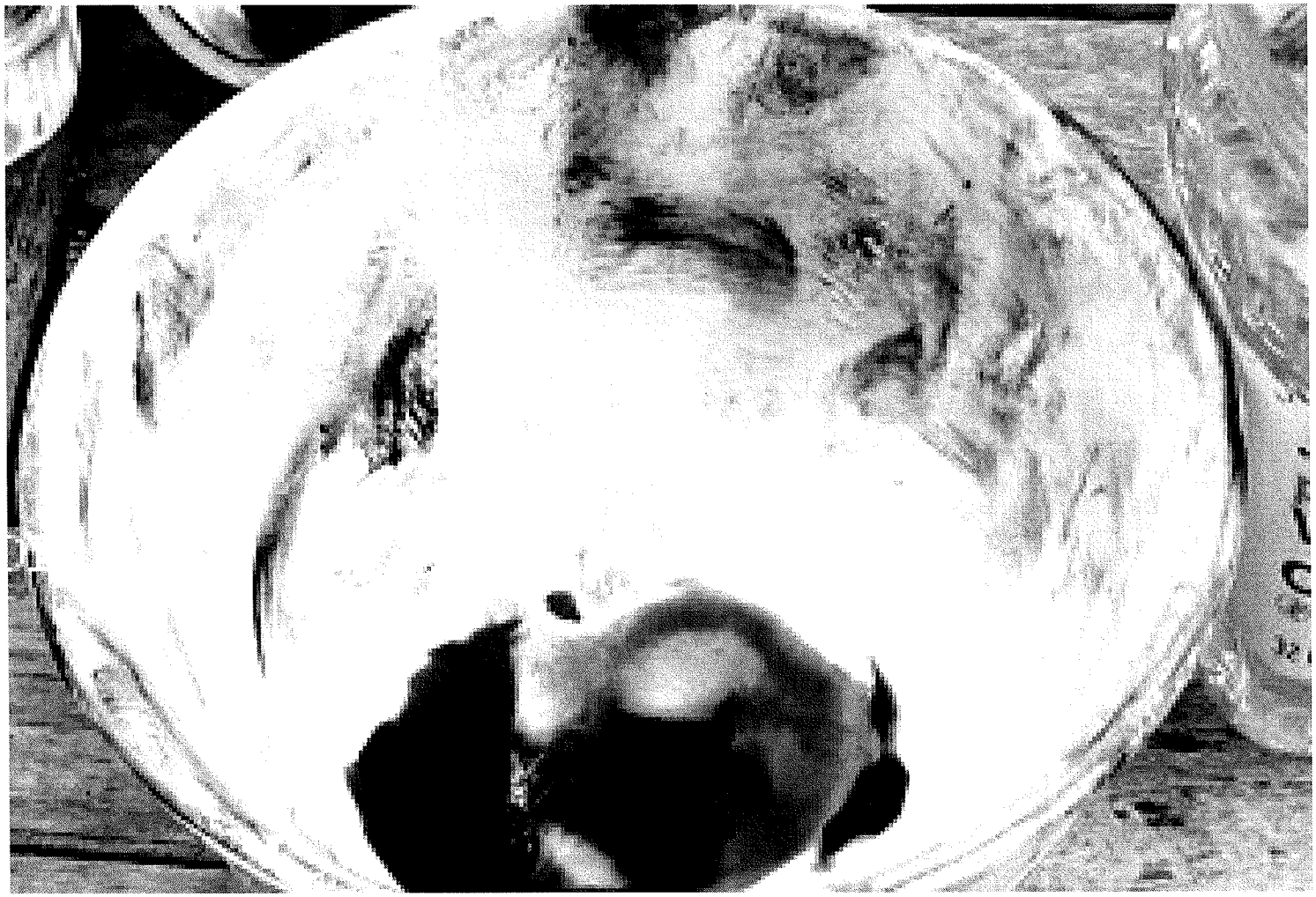
FIGS. 4-12 show pictures of experimental results from foul removal testing, including in conjunction with use of products and methods in accordance with aspects of the present invention.
Figure 5:
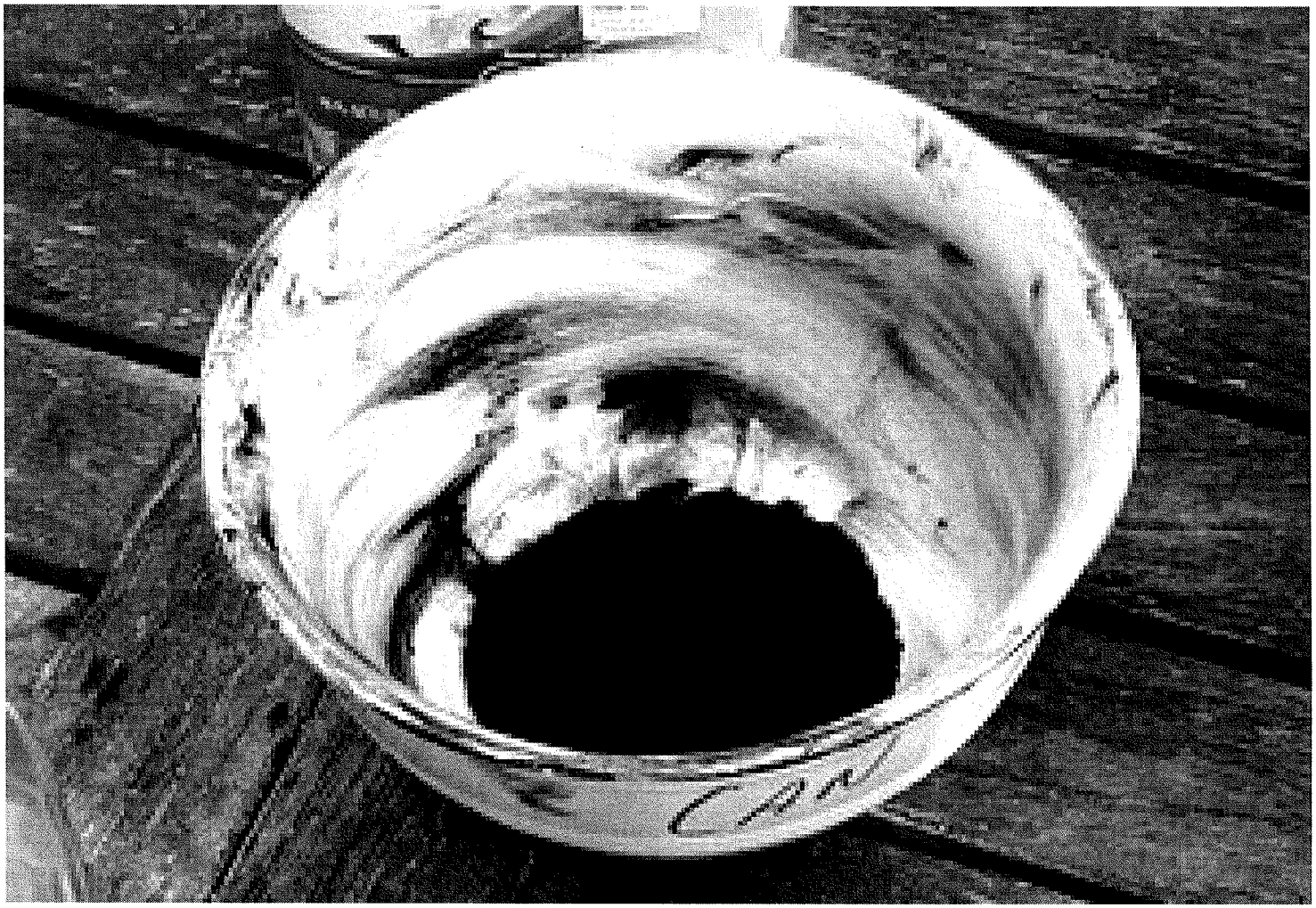
Figure 6:
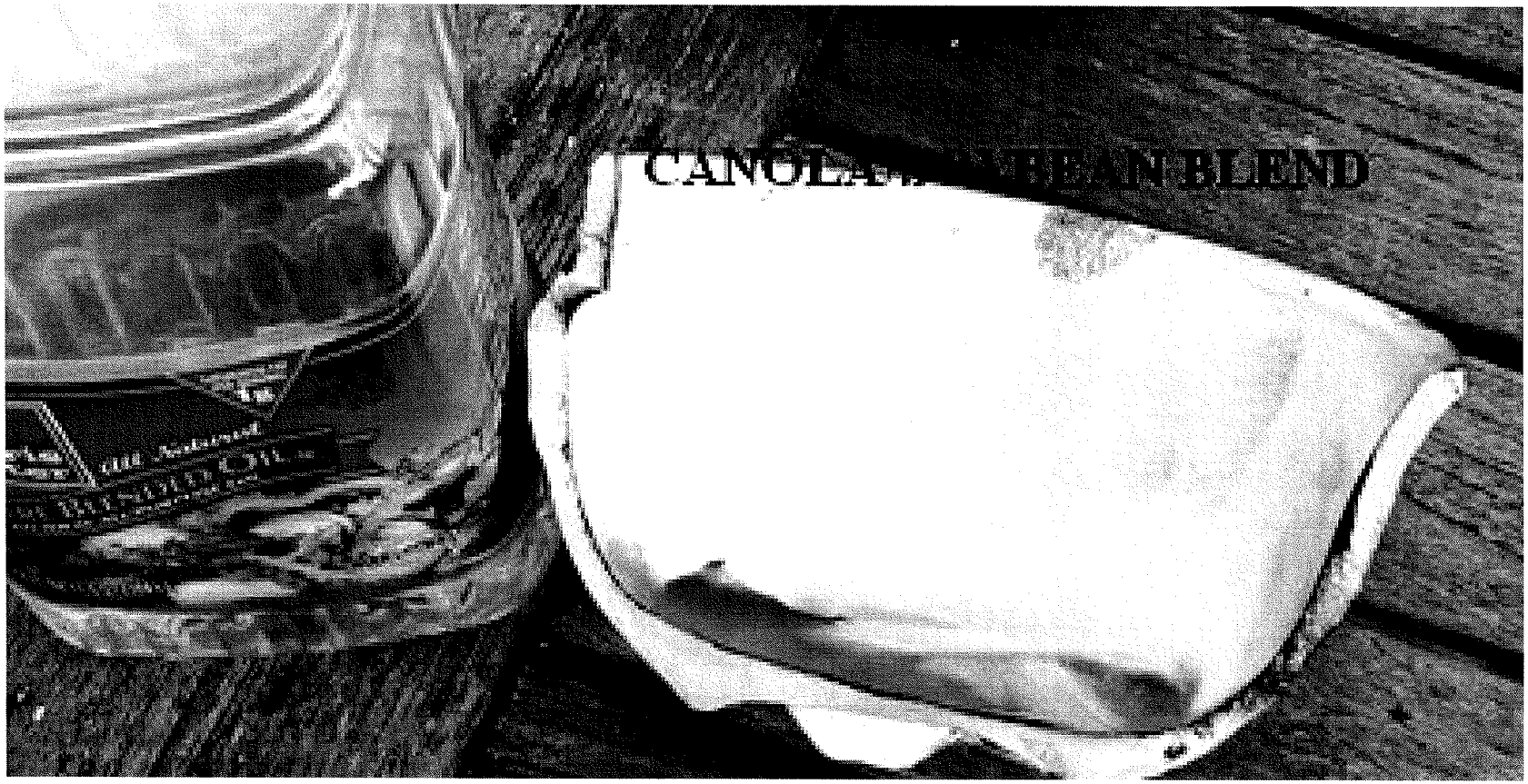

It has been surprisingly found that any single oil or a combination of oils selected from the following group are suitable for the above uses: almond (smoke point 430° F.), avocado (smoke point 520° F.), canola (smoke point 450° F. or higher), corn (smoke point 450° F.), cottonseed (smoke point 420° F.), flax seed (smoke point 250° F.), hazelnut (smoke point 430° F.), hemp seed (smoke point 330° F.), grapeseed (smoke point 485° F.), jojoba (smoke point 570 F), macadamia nut (smoke point 389° F.), olive (smoke point 460° F.), peanut (smoke point 450° F.), rapeseed (smoke point 438° F.), rice bran (smoke point 490° F.), safflower (smoke point 490-510° F.), sesame (smoke point 350° F.), soybean (smoke point 495° F. or higher), sunflower (smoke point 450° F. or higher), and walnut (smoke point 400° F.). Any one of these oils or combination thereof has been found to improve carbon fouling and carbon and other contaminant resistance without the problematic side effects discussed above, as compared to existing products on the market. As discussed above, high oleic versions of these oils are preferable, for some applications. To demonstrate the unexpected benefit of using the above oils to reduce or prevent carbon fouling, various oils and market products have been tested according to the following procedures. A 6" porcelain bowl is fouled with an oxy-acetalyne torch, with a rich flame to maximize carbon deposits. The flame is applied for 35 seconds (+/−5 seconds) at a distance of 4 inches (+/−2 inches) from the bowl to apply sufficient heat without overheating the bowl. This process heats the bowl to approximately 150-250° F. without cracking the bowl. The bowl is allowed to sit at room temperature 70° F. (+/−5° F.). Then, 5 ml (+/−0.5 ml) of a sample is applied to the fouled bowl. The fouled bowl containing the sample sits for 5 minutes. Next, the fouled bowl containing the sample is scrubbed by hand, using both sides of a 100% cotton round patch (2.20" circular, 0.200" thick-+/−10%) until the patch is fully soiled and unable to absorb any more carbon fouling. Remaining residue in the bowl is further scrubbed with a 100% cotton flannel patch (3.10" square, 0.020" thick-+/−10%) until fully soiled and unable to absorb any more carbon fouling. The bowl is rated on scale of 1 to 5, where 1 represents the most fouled, least effective and 5 represents the least fouled, most effective. FIG. 3 is a photostat of an example bowl that has been fouled prior to application of an example composition to simulate the U.S. Army's firing residue removal test. The above tests measure the ability of the oil composition to remove carbon. Carbon overload is a central reason that firearms run sluggishly (improperly) or cease operating entirely (lock up). FIGS. 4-6 are photos of the resulting bowls after application of vegetable oils is accordance with the present invention, illustrating the degree of fouling. FIGS. 7-12 are photos of the resulting bowls after application of various existing market compositions, illustrating the degree of fouling.

The results of the testing is organized in the following table:

TABLE 1

Figure 7:
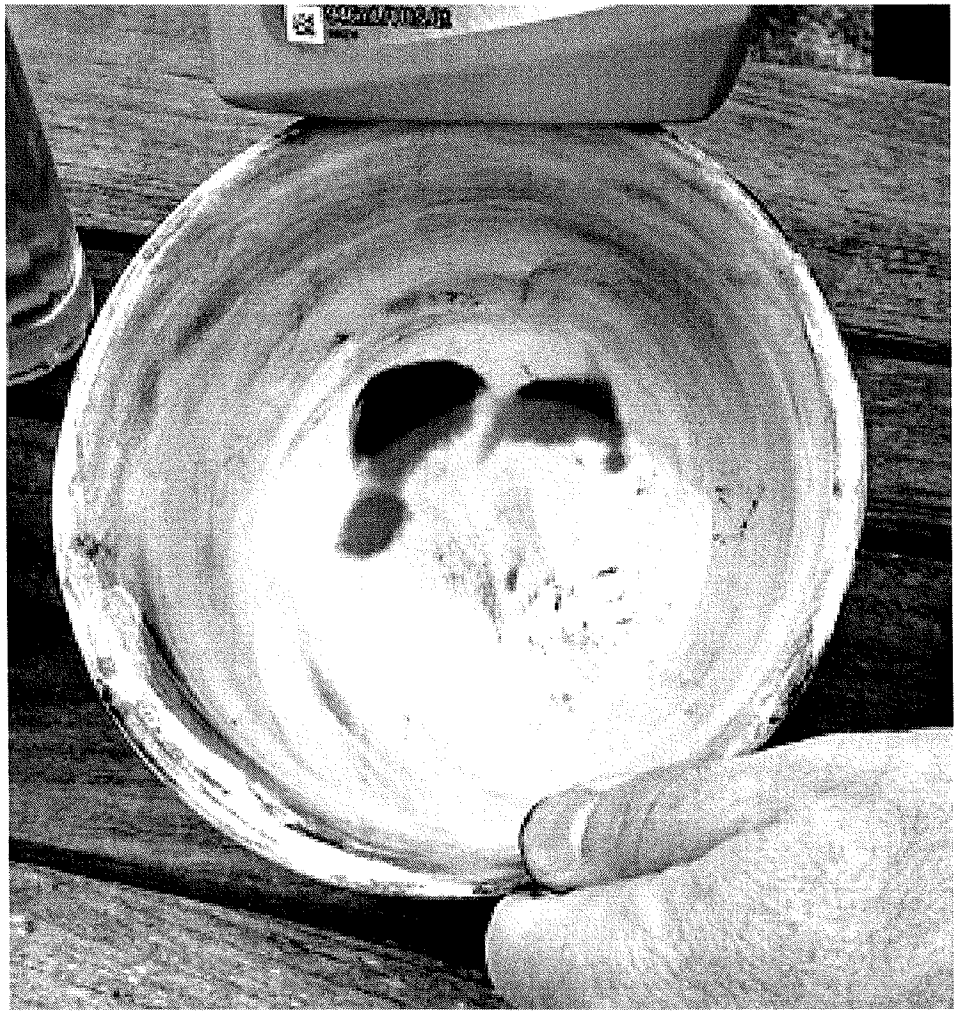
Figure 8:
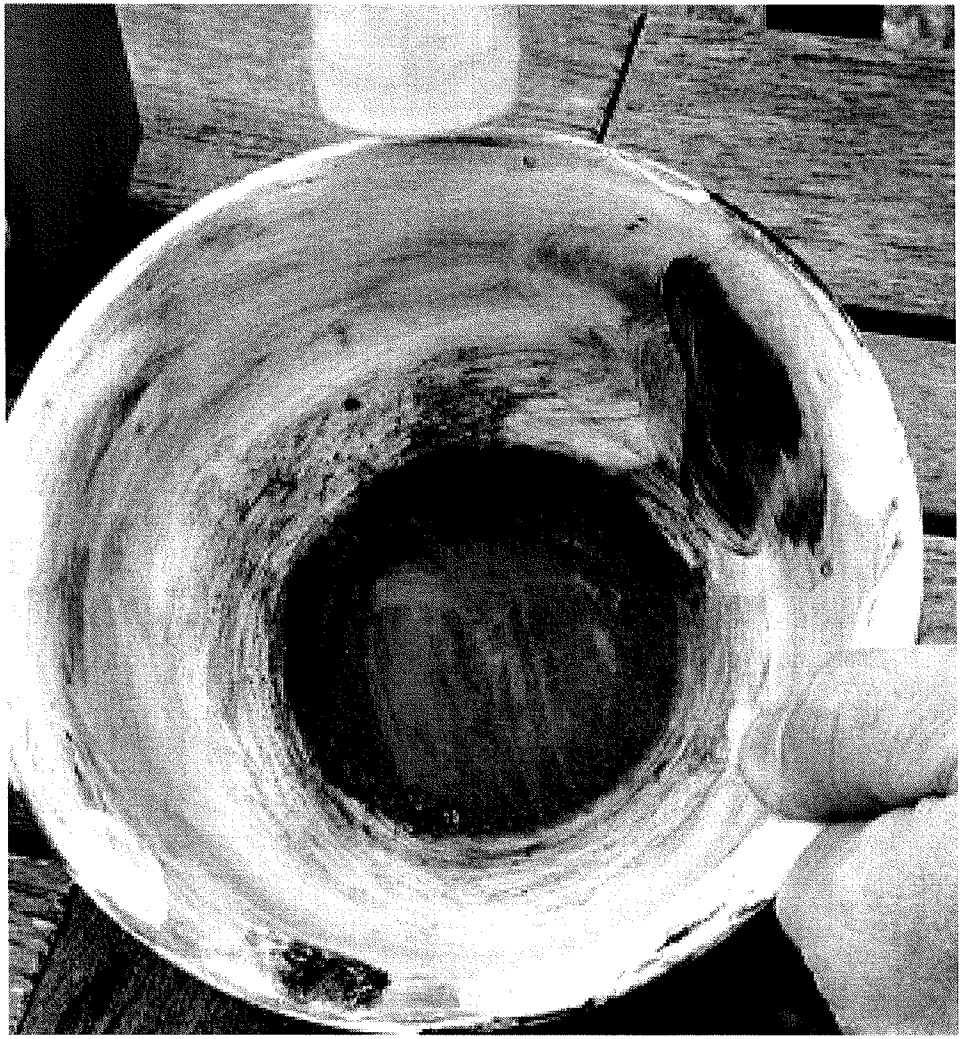
Figure 9:
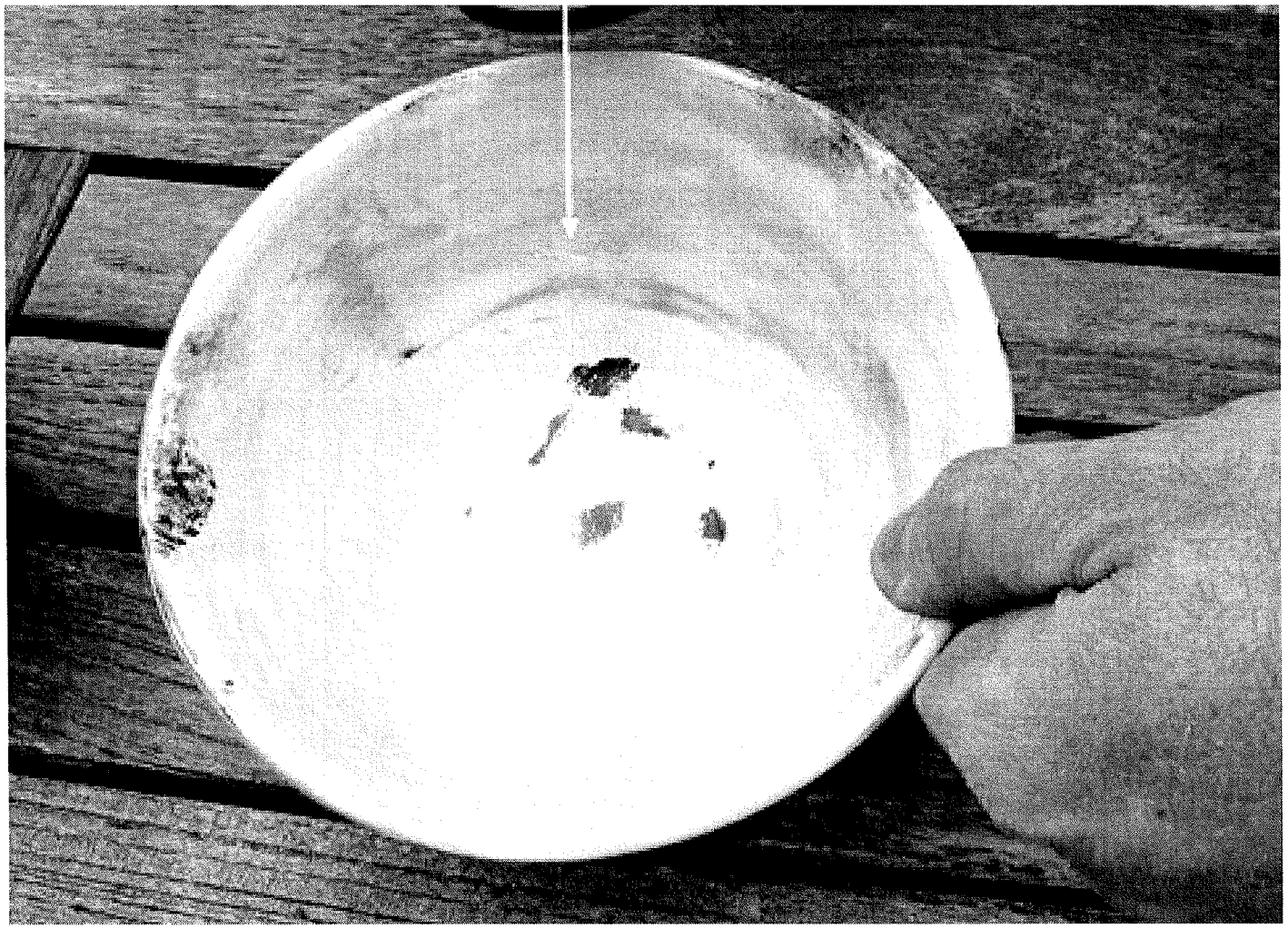
Figure 10:
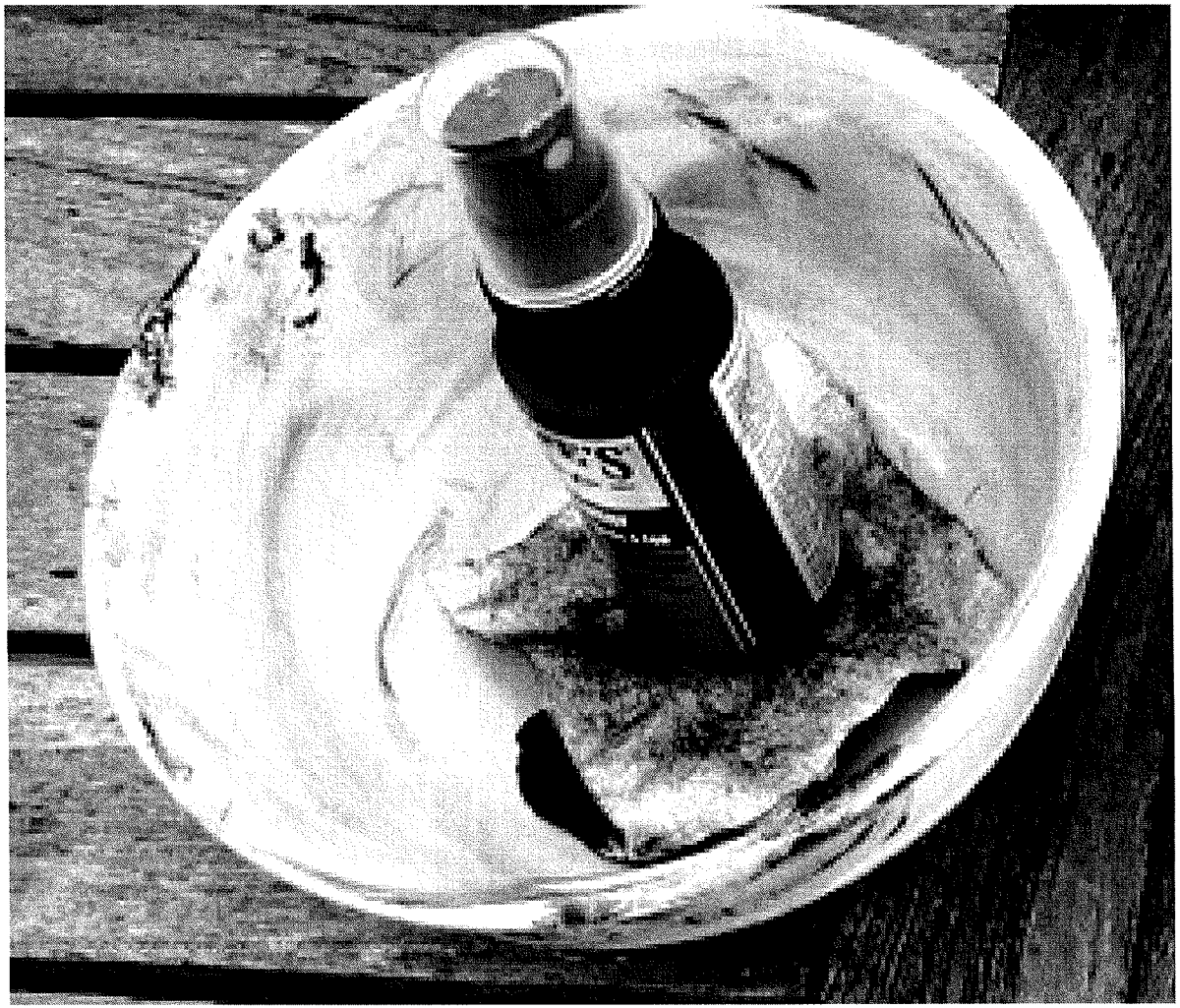
Figure 11:
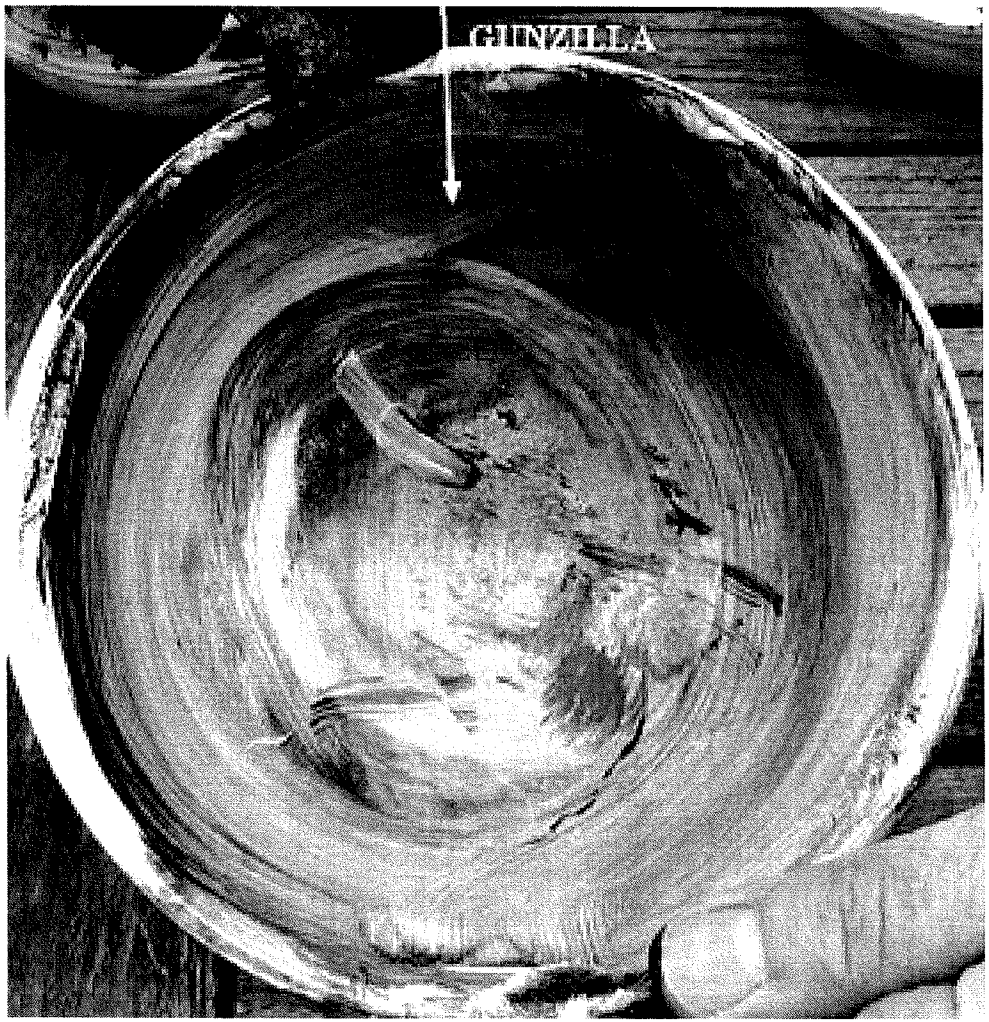
Figure 12:
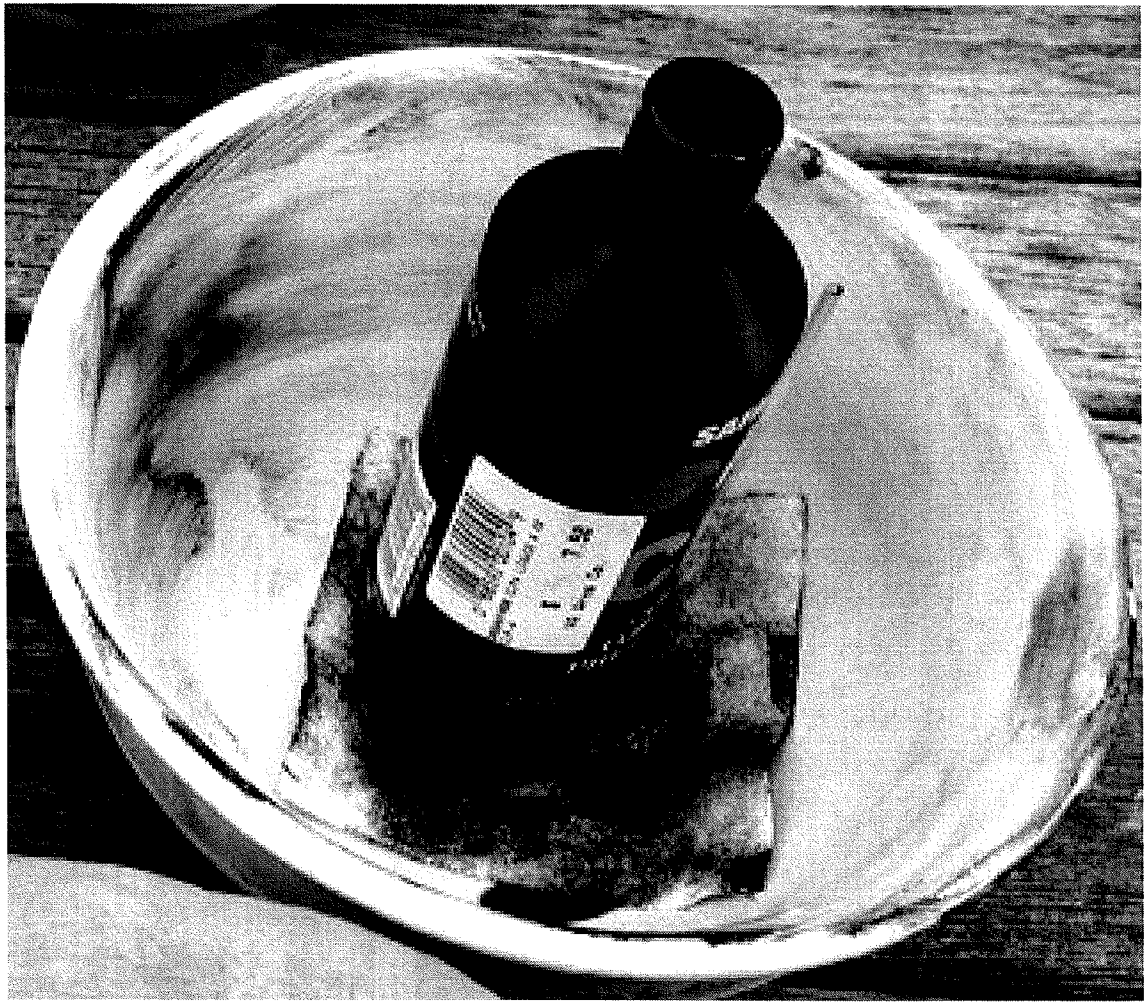

| Fouling Test | | |
|---|---|---|
| Oil Comp (by volume) | Rating 1-5 (1 = least effective, 5 = most effective) | Corresponding Figure |
| Example 1 - 100% Soybean | 2.75 (average of two samples) | FIG. 4 |
| Example 2 - 100% Canola | 1.5 | FIG. 5 |
| Example 3 - 80% Canola, 20% Soybean | 3.5 | FIG. 6 |
| Comparative Example 4 - Mobil 1 10W-30 | 3.0 | FIGS. 7 |
| Comparative Example 5 - FrogLube | 1.5 | FIG. 8 |
| Comparative Example 6 - SLIP2000 Carbon Killer | 4.5 | FIG. 9 |
| Comparative Example 7 - Hoppe's Elite | 4.0 | FIG. 10 |
| Comparative Example 8 - Gunzilla | 1.0 | FIG. 11 |
| Comparative Example 9 - Break Free | 2.0 | FIG. 12 |
| Example 10 - 100% Rice Bran | 2.5 | No Figure |
| Example 11 - 100% Walnut | 3.5 | No Figure |
| Example 12 - 100% Sesame | 3.0 | No Figure |
| Example 13 - 50% Rice Bran, 50% Soybean | 4.0 | No Figure |
| Example 14 - 33.3% Rice Bran, 33.3% Walnut, 33.3% | Between 4.0 and 4.5 | No Figure |

Table 1 demonstrates that pure vegetable oil compositions and blended vegetable oil compositions satisfactorily remove carbon fouling, without exhibiting the problems of the market lubricants. Notably, the natural vegetable oils in accordance with aspects of the invention were found to remove fouling without stripping oils from metal and can be used at a wide range of temperatures. Furthermore, it was found that a blend of vegetable oil (soybean and canola) was superior to a single oil. It should be noted that while pure vegetable oils are primarily discussed herein, it is within the scope of the invention that other components may be present (such as synthetic oils or additives) in amounts that do not substantially interfere with the above described properties. Thus, in an aspect of the present invention, the oil composition consists essentially of vegetable oils. In another aspect of the invention, the oil composition consists of vegetable oils.

Aspects of the present invention further include vegetable-based oil compositions. The vegetable oil composition may include a first vegetable oil having a smoke point above 200° F., a second vegetable oil, distinct from the first vegetable oil, having a smoke point above 200° F., and a third vegetable oil, distinct from the first and second vegetable oils, having a smoke point above 200° F. For example, each of the first, second, and third vegetable oils may have a smoke point of about 300° F., or yet more preferably for some applications, each may have a smoke point of about 400° F. In an aspect of the invention, each oil in the blend may include one or more of the properties discussed above. Each of the first, second, and third vegetable oils may be selected from the group consisting of: sesame oil, canola oil, sunflower oil, soybean oil, peanut oil, olive oil, corn oil, grapeseed oil, jojoba oil, cotton seed oil, almond oil, safflower oil, walnut oil, avocado oil, rice bran oil, and flaxseed oil. The composition may include, by volume, about 1% to about 80% of each of the first, second, and third vegetable oils, more preferably for some applications about 5% to about 60% of each vegetable oil, and most preferably for some applications about 7% to about 30% of each vegetable oil. The composition may further include any number of additional vegetable oils distinct from the first, second, and third vegetable oils, each being selected from the above list and being present in the above ranges. For example, the composition may include fourth, fifth, sixth, etc., vegetable oils.

As used herein, the term "distinct" means not the same as another vegetable oil and/or derived from a different plant, vegetable, fruit, shrub, flower, or tree nut. For example, canola oil is distinct from soybean oil.

In aspect of the present invention, the combined volume of the vegetable oils is at least about 25% of the total volume of the oil composition, more preferably at least about 50% of the total volume of the oil composition, still more preferably at least about 75% of the total volume of the oil composition, and most preferably about 100% or 100% the total volume of the oil composition.

In an aspect of the present invention, the composition may include, by volume, about 1% to about 80%, and more preferably for some applications about 5% to about 60% of each vegetable oil, and most preferably for some applications about 7% to about 30% of each of these vegetable oils. The composition may consist only of these oils. As noted above, the composition may include other components such as synthetic oils and other additives that don't substantially interfere with the above-described properties of the overall composition. As indicated by Table 1, it has been unexpectedly found that that certain combinations of vegetable oils are superior to both individual oils and commercial products in avoiding and removing carbon fouling from mechanical components without the problems associated with market compositions.

As shown in Table 1, it was surprisingly found that blends of vegetable oils are superior at removing carbon fouling than a single vegetable oil. See example 3, as compared to examples 1 and 2. Additionally, it was surprisingly found that a blend of vegetable oils sufficiently removes carbon fouling, without having the problems of the commercial products. See example 3, as compared to examples 4-9.

Any of the above-described oils may be applied to a mechanical component using the following methods. The composition may be deposited onto a surface. This deposition may be performed via brushing, dropping, spraying, or any other suitable delivery method such as applying with a paper towel or single pack moistened towelette, and spreading the applied oil evenly on the surface. The deposited composition may be allowed to air dry. Alternatively, the deposited composition may be heated to about 100 to about 400° F. to dry. The drying may be performed via convection oven, furnace, or any other suitable drying method such as for a period of time between 10 minutes and 12 hours, depending on the heat and material being treated. The treatment duration and temperature may depend on the size and material being treated. Certain metals may only withstand certain temperatures and exposure time, and, therefore, the precise time and temperature will vary. For example, a small aluminum piece, such as a charging handle that weighs 1.6 ounces, cannot withstand the same temperature intensity as a 16-ounce piece of ordnance-grade steel. The composition on the surface in the aluminum piece, for example, may be exposed to UV light (natural sunlight or lamp) to promote oxidation of the applied composition. In another aspect of the present invention, the mechanical component may be immersed in a tank containing the vegetable oil composition at a temperature of 100 to 400° F. for a period of time between 10 minutes and 24, hours depending on the material and/or the composition. In yet another aspect of the present invention, a pressure of about 1-5 ATM may be applied to the to the vegetable oil composition on the mechanical component via a pressure cooker, for example. The time of pressure application may vary from 10 minutes to 24 hours, depending on the material and composition. Furthermore, the application method may include any combination of the above steps.

The above step of depositing the composition on the surface of a mechanical component may include placing the composition in a container having a coating delivery system. For example, the container may have a pump spray, a trigger spray, or a dropper dispenser, each of which would assist a user in depositing the composition onto a mechanical component. The container may also be pressurized to allow for aerosol spraying of the composition inside. In another aspect of the present invention, the oil composition may be applied to a mechanical via a wipe, wherein the wipe contains the oil composition. For example, the wipe may be provided in a sealed package that may be opened when a user is ready to apply the oil composition to the mechanical component. Once removed from the sealed package, the user can then rub the wipe against the mechanical competent, thereby applying the oil composition onto the mechanical component. Alternatively, a sealed container may include a plurality of wipes, wherein each wipe contains the oil composition. The composition may be contained in a sealed, one-time use liquid only packet.

Example aspects have been described in accordance with the above advantages. It will be appreciated that these examples are merely illustrative of aspects of the invention. Many variations and modifications will be apparent to those skilled in the art.

The invention claimed is:

1. A method of removing or preventing carbon fouling on a mechanical component of a device, comprising:

depositing a vegetable oil composition on the mechanical component of the device; and drying the deposited oil composition by heating at a temperature of about 37.8° C. (100° F.) to about 204.4° C. (400° F.), wherein the vegetable oil composition comprises at least three vegetable oils, each vegetable oil having a smoke point above 93.3° C. (200° F.), and wherein at least one of the at least three vegetable oils has 80% by weight or greater oleic acid, wherein the combined volume of the at least three vegetable oils is present in an amount of about 100% by volume of the total volume of the oil composition; and wherein operation of the device deposits carbon on the mechanical component.

2. The method of claim 1, where the depositing step comprises one of spraying, immersing, or brushing the oil composition on the mechanical component of the device.

3. The method of claim 1, further comprising exposing the deposited composition to ultraviolet light.

4. The method of claim 2, wherein the mechanical component is immersed at a temperature of about 37.8° C. (100° F.) to about 204.4° C. (400° F.) for a period between about 10 minutes to about 24 hours.

5. The method of claim 1, wherein the depositing step comprises applying a pressure of about 1 to about 5 ATM.

6. The method of claim 1, wherein the mechanical component is a component of a firearm.

7. The method of claim 4, wherein the mechanical component of the firearm is selected from the group consisting of: a trigger, a hammer, a disconnector, a trigger pin, a firing pin, a chamber, a bolt, a bolt face, a bolt carrier, a breach face, a camming pin, a piston, an operating rod, a gas tube, a barrel, a slide, a retention rail, an upper receiver, a lower receiver, a magazine follower, a suppressor mount, a compensator, a flash hider, charging handle, feed tray, and a baffle.

* * * * *